US006546888B2

(12) United States Patent
Bertrand et al.

(10) Patent No.: US 6,546,888 B2
(45) Date of Patent: Apr. 15, 2003

(54) REMOVABLE STABILIZING FIN FOR A WATERCRAFT

(75) Inventors: François Bertrand, Valcourt (CA); Jean-Luc De Henau, Canton de Granby (CA); Éric Guevin, Valcourt (CA); François LaGloire, Rock Forest (CA); Normand Beauregard, Valcourt (CA)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 09/886,610

(22) Filed: Jun. 22, 2001

(65) Prior Publication Data

US 2002/0078875 A1 Jun. 27, 2002

Related U.S. Application Data

(60) Provisional application No. 60/213,479, filed on Jun. 23, 2000, and provisional application No. 60/229,314, filed on Sep. 1, 2000.

(51) Int. Cl.[7] ..... B63B 39/06

(52) U.S. Cl. ..... 114/126; 114/55.54

(58) Field of Search ..... 114/123, 126, 114/283, 292, 55.54, 140, 127; 441/79

(56) References Cited

U.S. PATENT DOCUMENTS

| | | | | |
|---|---|---|---|---|
| 3,516,099 A | * | 6/1970 | Morey et al. | 114/126 |
| 3,659,300 A | * | 5/1972 | Johnson | 441/79 |
| 4,805,546 A | * | 2/1989 | Geller et al. | 114/127 |
| 4,907,520 A | | 3/1990 | Pipkorn | |
| 5,425,534 A | * | 6/1995 | Chen | 473/549 |
| 5,597,337 A | * | 1/1997 | Nedderman, Jr. | 441/79 |
| 5,611,295 A | | 3/1997 | Stables | |
| 5,699,749 A | | 12/1997 | Yamada et al. | |
| 5,713,297 A | | 2/1998 | Tani et al. | |
| 5,794,556 A | | 8/1998 | Kobayashi | |
| 5,908,006 A | | 6/1999 | Ibata | |
| 5,975,974 A | * | 11/1999 | McCausland | 441/79 |
| 6,000,355 A | | 12/1999 | Hall | |
| 6,032,605 A | | 3/2000 | Takashima | |
| 6,041,727 A | | 3/2000 | Yamada et al. | |
| 6,058,873 A | | 5/2000 | Koyanagi | |
| 6,139,031 A | * | 10/2000 | Wingard | 280/14.28 |

OTHER PUBLICATIONS

Bombardier "Sea–Doo", Catalogue de pieces Parts Catalog 5810, 1990.

Bombardier "Sea–Doo", Catalogue de pieces Parts Catalog RX 5513/5514, 2000.

www.beachhousexpress.com, Beach House Engineering, Inc., 1998, pp. 1–2.

Bombardier's 2000 Sea–Doo RX D1 Parts Catalog; 2000; Sections D6 and D7 dated Apr., 2000.

* cited by examiner

*Primary Examiner*—Stephen Avila
(74) *Attorney, Agent, or Firm*—Pillsbury Winthrop LLP

(57) ABSTRACT

A stabilizing fin assembly for use with a watercraft includes a mounting structure, a stabilizing fin structure, and a releasable securement structure. The mounting structure is fixedly attached to a side portion of a hull of a watercraft. The stabilizing fin structure is removably mounted to the mounting structure. When the mounting structure is fixedly attached to the hull, the stabilizing fin structure is disposed externally of the hull and adjacent the side portion of the hull in an operative position wherein at least a portion of the stabilizing fin structure extends into a body of water while the watercraft is in a normal operative position. The releasable securement structure is disposed in a releasably secured position on the hull. The stabilizing fin structure facilitates removal and replacement of the stabilizing fin structure without requiring access to the interior of the watercraft.

59 Claims, 13 Drawing Sheets

REMOVABLE STABILIZING FIN FOR A WATERCRAFT

This application claims the benefit of priority to U.S. Provisional Patent Application No. 60/213,479, filed on Jun. 23, 2000, and U.S. Provisional Patent Application No. 60/229,314, filed on Sep. 1, 2000, both of which are incorporated herein by reference.

FIELD OF THE INVENTION

The present invention relates in general to watercraft. In particular, the present invention relates to an improved removable stabilizing fin for a watercraft.

BACKGROUND OF THE INVENTION

It is known in the art that stabilizing fins on the port and starboard sides of a hull of a watercraft, such as a personal watercraft, improve the stability and handling of the watercraft. U.S. Pat. No. 6,041,727 to Yamada et al. and U.S. Pat. No. 5,611,295 to Stables disclose examples of a watercraft having a pair of such stabilizing fins.

FIG. 1 illustrates an example of a prior art arrangement. A portion of a hull 14 has a plurality of fastener receiving openings formed therethrough. Similarly, an attachment portion of a stabilizing fin 12 has a corresponding plurality of fastener receiving openings formed therethrough. To mount stabilizing fin 12 to hull 14, stabilizing fin 12 is placed against the surface of hull 14 with the sets of fastener receiving openings in alignment, and a set of fasteners (i.e., threaded bolts) 22 are inserted through the fastener receiving openings. Then, a set of threaded nuts are threaded onto the ends of fasteners 22 inside hull 14 and tightened to secure stabilizing fin 12 against the exterior of hull 14. Finally, a cover (not shown) is placed on stabilizing fin 12 to hide fasteners 22 and to provide a smooth upper surface.

The problem with the arrangements of the prior art is that access to the inside of hull 14, and in particular, access to the threaded nuts inside of hull 14, is necessary in order to remove stabilizing fin 12 from hull 14. This task is tedious, in part, because of the limited maneuvering space inside hull 14, and because of the number of fasteners 22 and nuts required. This makes it difficult for operators of watercraft to replace or simply remove stabilizing fin 12 (should such action be required or desired). Accordingly, there is a need in the art for an improved stabilizing fin that is removable from hull 14 without requiring access to the inside of hull 14.

SUMMARY OF THE INVENTION

The present invention provides a number of embodiments that address this deficiency (among others) in the prior art. In particular, the present invention provides for the construction of a stabilizing fin assembly that permits the rapid attachment of a stabilizing fin to the exterior of a watercraft, eliminating the need for access the interior of the watercraft to effect such attachment.

One embodiment of the present invention provides a watercraft including a hull, a power-operated propulsion system, a steering control system, and at least one stabilizing fin assembly. The hull buoyantly supports the watercraft on a surface of a body of water. The power-operated propulsion system moves the watercraft along the surface of the body of water. The steering control system includes a steering input device, and steers the watercraft based on movement of the steering input device by an operator riding the watercraft. The at least one stabilizing fin assembly may include at least one of a port stabilizing fin assembly and a starboard stabilizing fin assembly. Each individual stabilizing fin assembly includes a mounting structure, a stabilizing fin structure, and a releasable securement structure. The mounting structure is fixedly attached to an associated one of the port and starboard side portions of the hull. The stabilizing fin structure is disposed externally of the hull and adjacent the associated one of the port and starboard side portions of the hull in an operative position wherein at least a portion of the stabilizing fin structure extends into the body of water while the watercraft is in a normal upright position. The releasable securement structure is disposed in a releasably secured position, wherein the releasable securement structure releasably secures the stabilizing fin structure to the mounting structure. The mounting structure cooperates to releasably retain the stabilizing fin structure in the operative position thereof. The releasable securement structure is constructed and arranged to be moved from the releasably secured position to a released position wherein the releasable securement structure releases the stabilizing fin structure from the mounting structure so as to permit the stabilizing fin structure to be removed from the operative position thereof. The releasable securement structure is accessible entirely externally of the hull without the need for accessing an interior of the hull for movement between the releasably secured and released positions thereof.

BRIEF DESCRIPTION OF THE DRAWINGS

In the drawings, like reference numerals represent similar parts of the present invention throughout the several views in which.

DETAILED DESCRIPTION OF THE INVENTION

Figure 2:
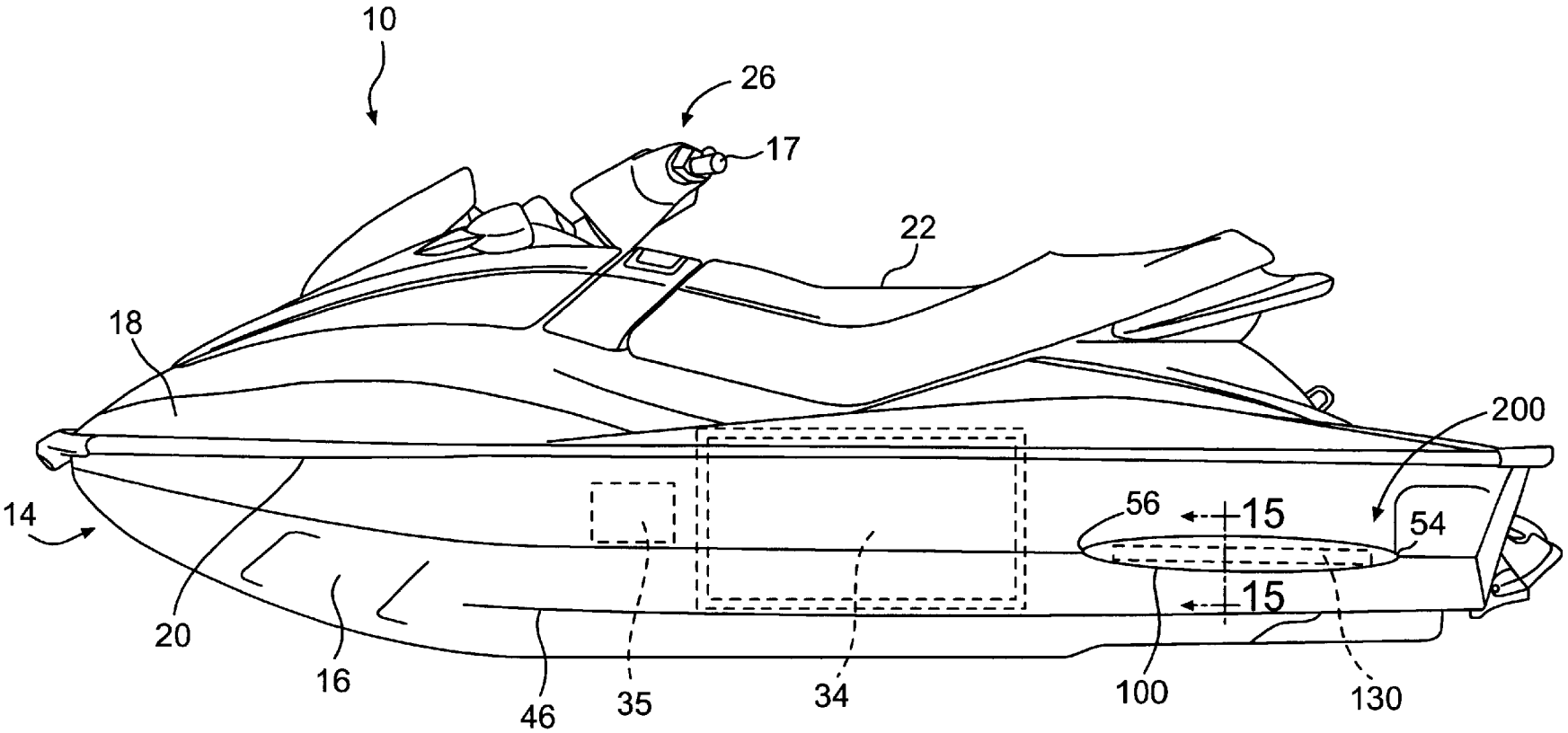
FIG. 2 is a side view of a watercraft with a stabilizing fin in accordance with one embodiment of the present invention.
Figure 3:
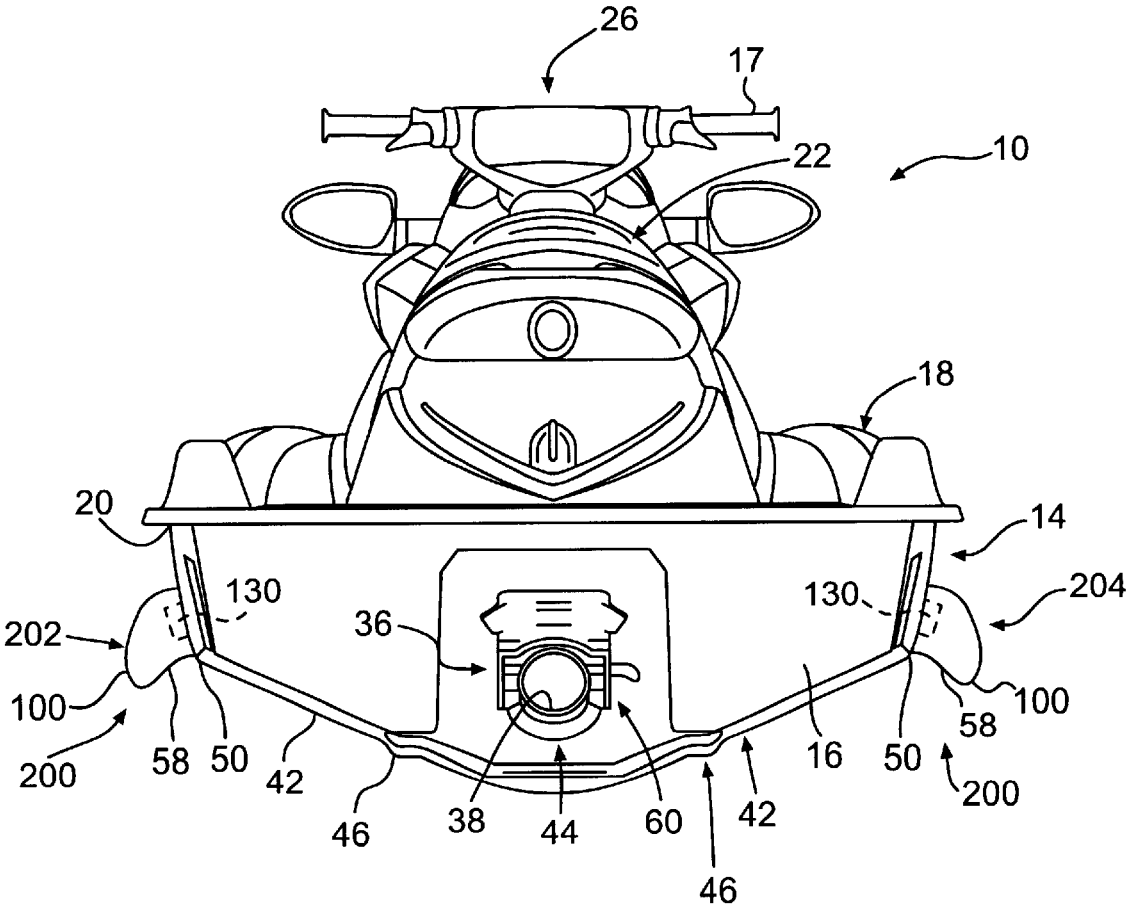
FIG. 3 is a rear view of the watercraft of FIG. 2, showing the stabilizing fins in somewhat exaggerated detail (for purposes of explanation)

FIGS. 2 and 3 illustrate an exemplary watercraft 10, which comprises a personal watercraft, with exemplary stabilizing fin assemblies 200.

Before describing stabilizing fin assemblies 200, exemplary watercraft 10 will be described in general detail to assist the reader's understanding of the present invention. As would be understood by those skilled in the art, however, the present invention is not limited solely to the watercraft and components of the watercraft illustrated and described.

Watercraft 10 includes a hull 14, a power-operated propulsion system 60, a steering control system 26, and a pair of stabilizing fin assemblies 200. An engine 34 powers watercraft 10, and may be located in hull 14, wherein hull 14 includes a lower hull section 16 and an upper deck section 18. Engine 34 is located beneath a removable seat 22 covering an engine access opening defined in the upper deck 18. A battery 35 may be positioned proximate to engine 34 to provide electrical power to start engine 34. Engine 34 drives the power-operated propulsion system 60 (FIG. 3) to move watercraft 10 along a surface of a body of water. Power-operated propulsion system 60 is located in a tunnel 36 (FIG. 3) in the rear center of lower hull section 16.

An output shaft of the engine drives an impeller of power-operated propulsion system 60. The impeller draws water in through an inlet port of power-operated propulsion system 60, and discharges the water from a venturi in a pressurized stream through a steering nozzle 38. Steering nozzle 38 is pivotally supported at the rear of the power-operated propulsion system 60 to change the thrust angle of the pressurized stream of water on watercraft 10 for steering purposes. Steering nozzle 38 is connected to a steering input device 17, which is mounted on the upper deck 18 in front of seat 22. Steering input device 17 may include a throttle control for controlling the speed of engine 34. Steering nozzle 38 and steering input device 17 form part of a steering control system 26, which steers watercraft 10 based on movement of steering device 17 by an operator riding watercraft 10.

Hull 14 buoyantly supports watercraft 10 on the surface of the body of water, and as described above includes lower hull section 16 and upper deck section 18. Lower hull section 16 and upper deck section 18 are fixed to each other around peripheral edges 20 in a suitable manner. FIG. 3 illustrates that lower hull section 16 generally has a "V"-bottom formed by a pair of angularly disposed surfaces 42, which extend outwardly from a central recess section 44. Each angularly disposed surface 42 may include chines 46 as is known in the art. Chines are protrusions that extend out of angularly disposed surface 42 along a longitudinal direction of the hull 16.

FIG. 3 illustrates that stabilizing fin assemblies 200 include a port stabilizing fin assembly 202 and a starboard stabilizing fin assembly 204. The pair of stabilizing fin assemblies 200 are identical mirror images of each other. Thus, the description herein of one stabilizing fin assembly 200 will be understood as applying equally to both unless specified to the contrary.

Watercraft 10 may include any number of stabilizing fin assemblies 200 in order to suit a particular application or loading condition. For example, the invention contemplates the use of two or more pairs of stabilizing fin assemblies. With two or more pairs, the fin structures on each side of the hull could be spaced apart, or abutted or interconnected in end to end relation to form a line of elongated fin structures. Further, the size and shape of stabilizing fin assemblies 200 may be varied according to the desired handling characteristics of watercraft 10.

As shown in FIGS. 2, 15, 16, and 17 stabilizing fin assembly 200 includes a mounting structure 130, a stabilizing fin structure (i.e., sponson) 100, and a releasable securement structure in the form of a single threaded fastener 162 (FIG. 16) and a plurality of fasteners 164 that affix mounting structure 130 to lower hull section 16. Releasable securement structure 162 (see FIGS. 16 and 17) is disposed in a releasably secured position, wherein releasable securement structure 162 releasably secures stabilizing fin structure 100 to mounting structure 130. In this releasably secured position, releasable securement structure 162 releasably retains stabilizing fin structure 100 in an operative position.

Releasable securement structure 162 and mounting structure 130 are constructed and arranged such that releasable securement structure 162 is accessible externally of hull 14 without the need for accessing an interior of hull 14 to release or retain stabilizing fin structure 100 thereto. Releasable securement structure 162 is movable from the releasably secured position to a released position, wherein the releasable securement structure releases stabilizing fin structure 100 from mounting structure 130 so as to permit stabilizing fin structure 100 to be removed from the operative position thereof for replacement by another stabilizing fin structure 100 or for repair and remounting.

To assist in attaching mounting bracket 164 to lower hull section 16, an insert 135 is mounted on the interior of lower hull section 16 to retain threaded fasteners 164. While it is preferred that insert 135 be affixed to the interior of lower hull section 16 by adhesive, those skilled in the art will readily appreciate that alternate attachment means may be employed without departing from the scope of the present invention.

While a threaded fastener 164 is illustrated as the preferred way to attach mounting structure 130 to lower hull section, those skilled in the art would readily appreciate that other fasteners could be substituted therefor without departing from the scope of the present invention.

Stabilizing fin structure 100 is disposed externally of hull 14 and adjacent to a side portion of hull 14 in the operative position wherein at least a portion of stabilizing fin structure 100 extends into the body of water while watercraft 10 is in a normal upright position. FIG. 3 illustrates that stabilizing fin structure 100 is attached above a chine 50 of lower hull section 16. Stabilizing fin structure 100 is mounted to mounting structure 130 proximate to the stern of watercraft 10, and extends outwardly for increased stability and handling of watercraft 10. Alternatively, stabilizing fin structure 100 may be mounted to mounting structure 130 proximate to the front of watercraft 10, which may be desired in specialized high performance racing conditions.

FIG. 2 illustrates that stabilizing fin structure 100 has an elongated rib-like configuration with a length substantially shorter than the length of hull 14. The shape of stabilizing fin structure 100, as can be seen in FIG. 2, is generally straight with nose 56 positioned at the fore end curving upwardly to give stabilizing fin structure 100 a substantially streamline shape in the direction of water flow. FIG. 3 illustrates that stabilizing fin structure 100 protrudes downward to give stabilizing fin structure 100 a generally fin-like shape. Stabilizing fin structure 100 includes an arcuate lower surface 58 that is formed on its underside that extends away from lower hull section 16. Stabilizing fin structure 100 tapers in size in the vertical direction toward fore end 56, which does not significantly protrude downwardly, if at all.

It should be noted that stabilizing fin 100 may extend downwardly from hull 14 to any extent required for suitable operation of watercraft 10. It is contemplated that stabilizing fin 100 may extend to the downward position illustrated in FIG. 3 or any other suitable outward or downward position depending on the operational characteristics desired for watercraft 10. In other words, the size or shape of stabilizing fin 100 is not critical to the present invention. As would be understood by those skilled in the art, other shapes and sizes may be substituted therefor without departing from the scope and spirit of the present invention.

It should also be noted that the present invention facilitates the removal and replacement of stabilizing fins 100 of one size and shape for another. Different shapes and sizes of stabilizing fins 100 are expected to affect the operational characteristics of watercraft 10 differently. Accordingly, with the present invention, if the operator of a particular watercraft 10 desires to change the operational characteristics of that watercraft, the operator may remove and replace stabilizing fins 100 with fins that provide desired handling characteristics.

Figure 4:
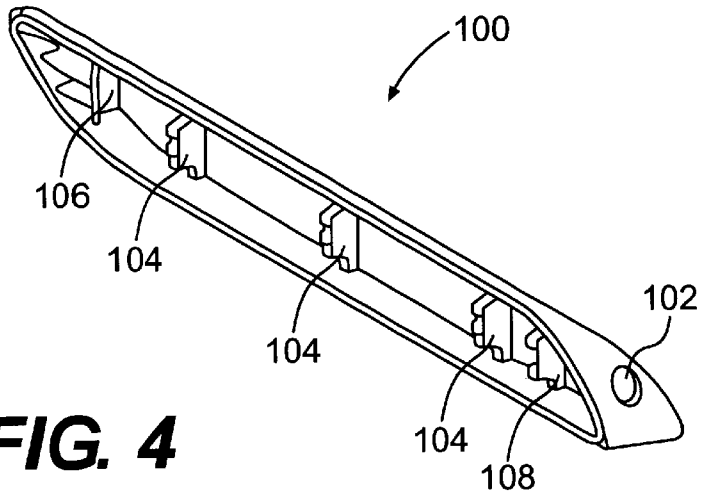
FIG. 4 is a perspective view of the stabilizing fin of FIG. 2.

FIG. 4 illustrates a perspective view of the preferred embodiment of stabilizing fin structure 100. Stabilizing fin structure 100 includes a plurality of interlocking structures (also referred to as hooks or tabs) 104, 106, 108 and a fastener receiving opening 102 formed through stabilizing fin structure 100 at the aft end. Alternatively, stabilizing fin structure 100 may include fastener receiving opening 102 formed through stabilizing fin structure 100 at the front end.

Figure 5:
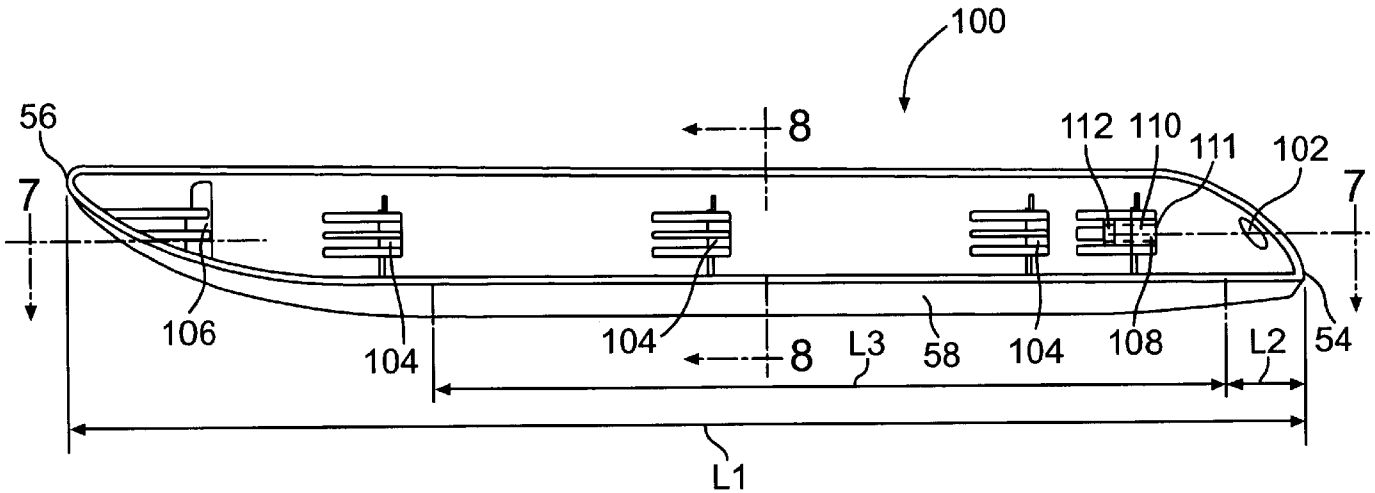
FIG. 5 is a side view of the stabilizing fin of FIG. 2.

FIG. 5 illustrates a side view of stabilizing fin structure 100, which includes a fastener receiving passage 110 that is aligned with fastener receiving opening 102, and is formed as a part of interlocking structure 108. A threaded structure (i.e., threaded nut) 112, which is similarly aligned with fastener receiving opening 102, is fixed within interlocking structure 108. Threaded structure 112 could also be integrally formed with stabilizing fin structure 100.

In the embodiment illustrated in FIG. 5, a housing 111 is integrally molded with interlocking structure 108 (as a part of stabilizing fin structure 100). In the preferred embodiment, housing 111 defines receiving passage 110, which is disposed adjacent to threaded structure 112. Receiving passage 110 itself may also be threaded, although it is not in the preferred embodiment of the present invention. While threaded structure 112 may be integrally molded as a part of interlocking structure 108, in the preferred embodiment of the present invention, housing 111 includes a space for threaded structure 112, which is inserted into interlocking structure 108 after fin structure 100 is molded. Threaded structure 112 may be manufactured from aluminum, plastic, or any other material capable of resisting corrosion when immersed in water (preferably salt water).

Figure 6:
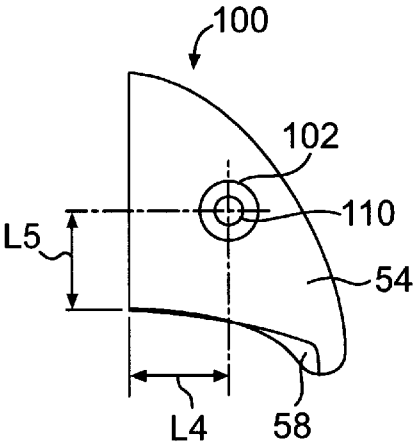
FIG. 6 is a rear view of the stabilizing fin of FIG. 2.

FIG. 6 illustrates fastener receiving opening 102 located at the aft end of stabilizing fin structure 100. In the preferred embodiment, fastener receiving opening 102 is a hole through fin structure 100 at its aft end 54. Opening 102 preferably is larger in diameter than the fastener receiving passage 110. The wider diameter of opening 102 is provided so that the end of a threaded fastener (such as bolt 162, FIG. 16) may be more easily manipulated to remove the threaded fastener from passage 110. While a circular opening is illustrated, those skilled in the art would readily appreciate that the opening could be of any shape suitable for removing the threaded fastener from passage 110.

Figure 7:
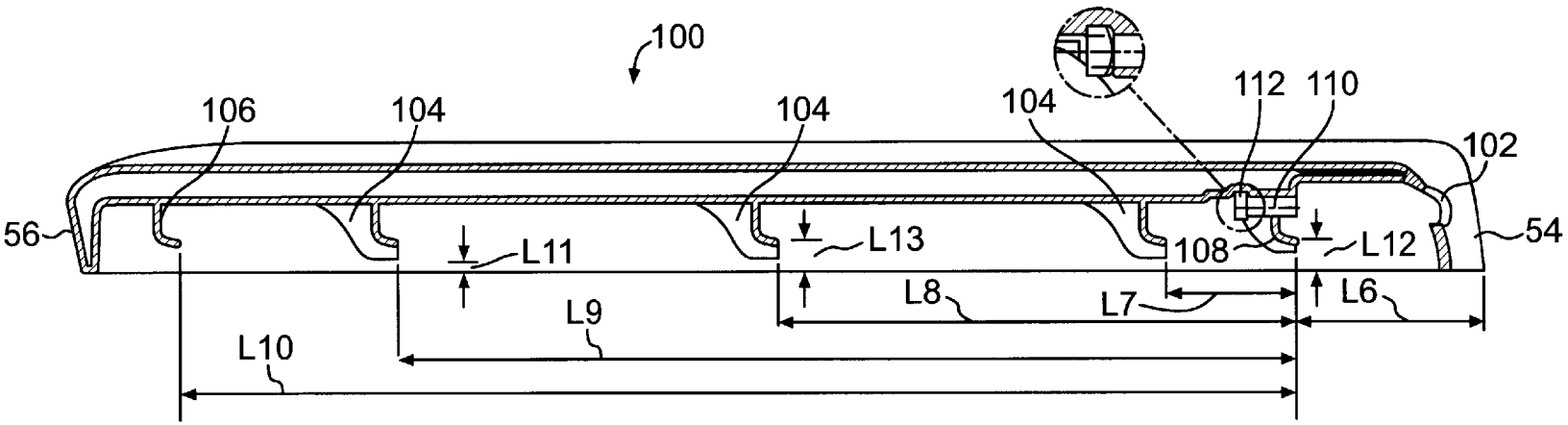
FIG. 7 is a cross-sectional view of the stabilizing fin taken along line 7—7 of FIG. 5.
Figure 17:
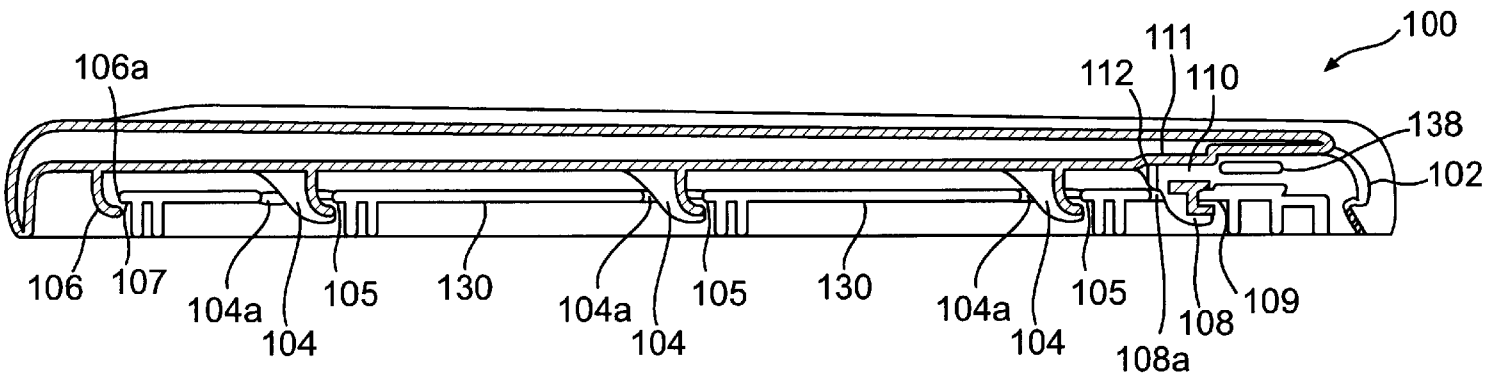
FIG. 17 is a cross-sectional view of the stabilizing fin of FIG. 15, taken along the line 17—17.

FIG. 7 illustrates a cross-sectional view of stabilizing fin structure 100 taken along line 7—7 of FIG. 5, and depicts the preferred embodiment of the configuration of threaded structure 112. Interlocking structures (also referred to as hooks or tabs) 104, 106, and 108 are illustrated in detail. Hooks 104, 106, and 108 are designed to cooperate with ledges 105, 107, and 109 (generally depicted at 134 in FIG. 10) on mounting structure 130. FIG. 17 is illustrative of the cooperative relationship between fin 100 and mounting structure 130. As shown, hooks 104, 106, 108 are oriented to point in the same direction. This facilitates attachment of fin 100 to mounting structure 130.

To mount fin 100 to watercraft 10, fin 100 is first placed over mounting structure 130 so that hooks 104, 108 are positioned through openings 104*a*, 108*a*. Hook 106 catches the end 106*a* of mounting structure 130 and, therefore, is not positioned within any hole or opening. (See FIG. 9.) After fin 100 is positioned so that hooks 104, 108 protrude into holes 104*a*, 108*a*, fin 100 is shifted so that hooks 104, 106, 108 engage ledges 105, 107, 109 to prevent fin 100 from dislodging from mounting structure 130. This is shown in FIG. 17.

After hooks 104, 106, 108 engage ledges 105, 107, 109, fastener 162 is inserted through opening 102 until it engages fastening structure 112 adjacent to passage 110. Once fastener 162 is in place, fin 100 cannot slide relative to mounting structure 130. In this manner, fin 100 is securely, yet removably, affixed to mounting structure 130.

Preferably, hooks 104, 106, 108 point toward the rear of watercraft 10 when fin 100 is mounted thereon. This assures that fin 100 will not be easily dislodged from mounting structure 130, should the operator hit a submerged obstacle with fin 100. This arrangement also is preferred because stresses and forces on the threads of fastener 162 are reduced during connection of fin 100 to mounting structure 130.

Figure 8:
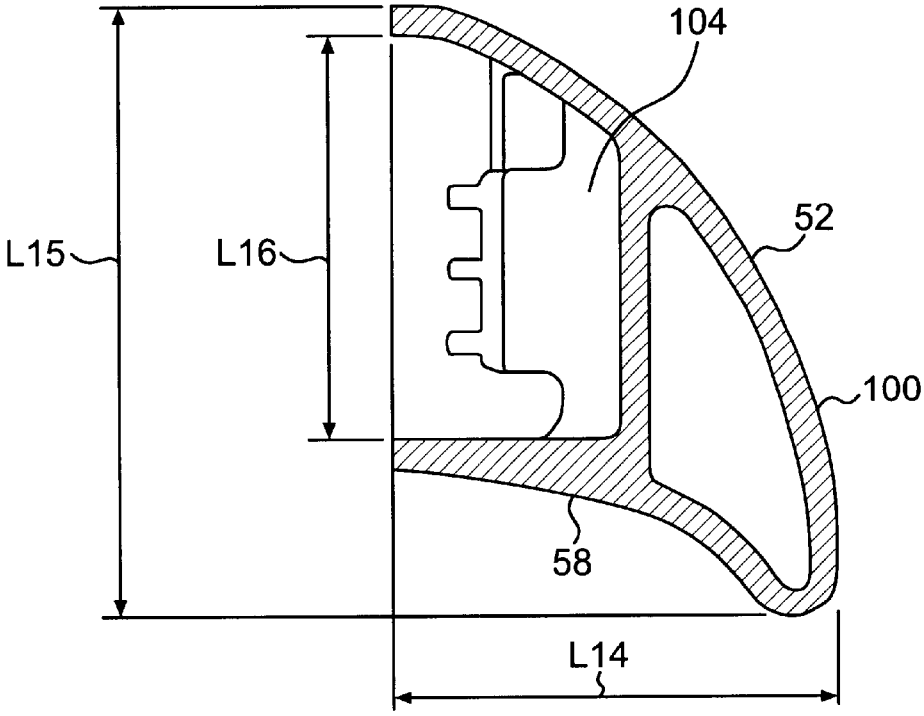
FIG. 8 is a cross-sectional view of the stabilizing fin taken along line 8—8 of FIG. 5.

FIG. 8 illustrates a cross-sectional view of stabilizing fin structure 100 taken along line 8—8 of FIG. 5. Stabilizing fin structure 100 includes hollow portions therein that may fill with water while watercraft 10 is in the normal upright position because stabilizing fin structure 100 may not be sealed. Stabilizing fin structure 100 provides lift for and improves turning grip of watercraft 10 on the surface of the body of water. Thus, stabilizing fin structure 100 improves the stability and handling of watercraft 10. Table 1, which references FIGS. 5–8, illustrates one embodiment of the size of stabilizing fin structure 100.

TABLE 1

| FIG. 5 | | FIG. 6 | | FIG. 7 | | FIG. 8 | |
|---|---|---|---|---|---|---|---|
| LABEL | LENGTH | LABEL | LENGTH | LABEL | LENGTH | LABEL | LENGTH |
| L1 | 571 mm | L4 | 22.5 mm | L6 | 71.2 mm | L14 | 49 mm |
| | | L5 | 18.35 mm | L7 | 50 mm | L15 | 64.8 mm |
| | | | | L8 | 200 mm | L16 | 44 mm |
| | | | | L9 | 350 mm | | |
| | | | | L10 | 435 mm | | |
| | | | | L11 | 3 mm | | |
| | | | | L12 | 10.3 mm | | |
| | | | | L13 | 11.46 mm | | |

Figure 9:
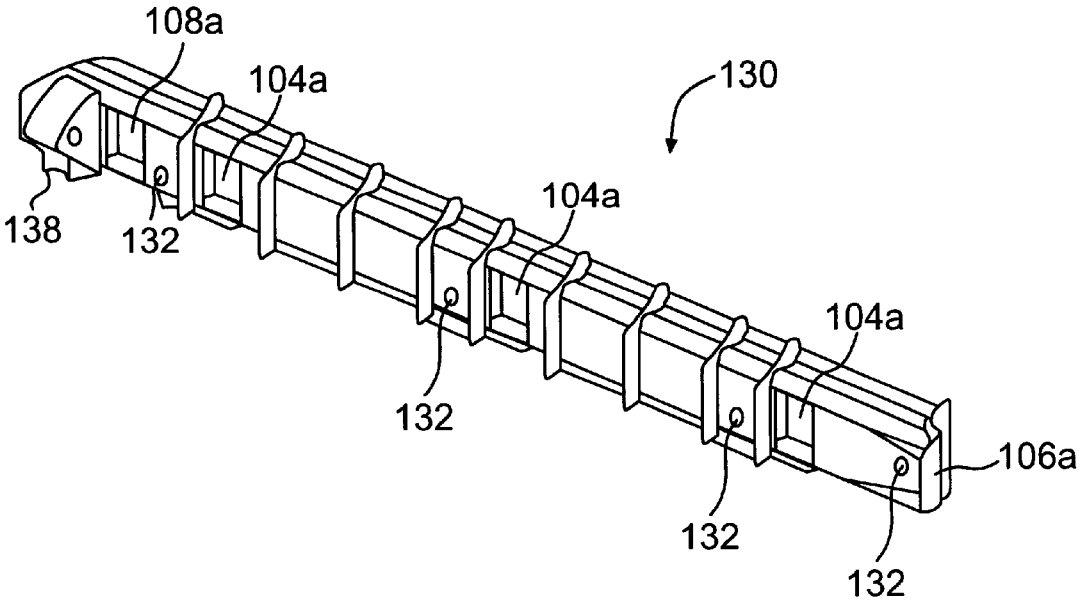
FIG. 9 is a perspective view of a mounting structure in accordance with one embodiment of the present invention.

FIG. 9 illustrates a perspective view of the preferred embodiment of mounting structure 130, which includes fastener receiving openings 132, 138 formed therethrough. FIG. 9 illustrates mounting structure 130 including fastener receiving opening 138 formed through mounting structure 130 at the aft end. Alternatively, mounting structure 130 may include fastener receiving opening 138 formed through mounting structure 130 at front end 54 in the case where opening 102 is positioned at front end 54 of fin 100.

Figure 10:
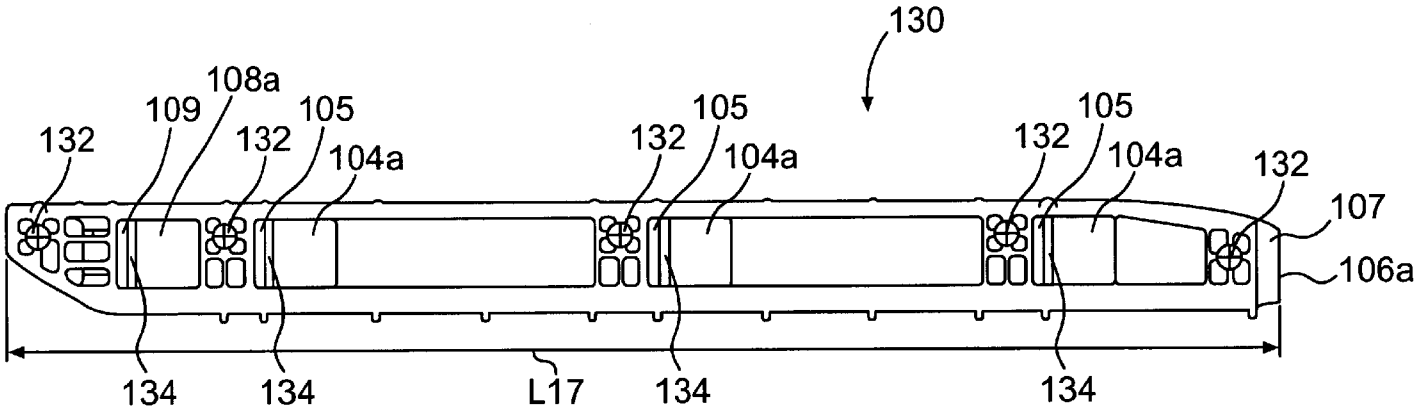
FIG. 10 is a side view of the mounting structure of FIG. 9.

FIG. 10 illustrates one side of mounting structure 130, which includes a plurality of interlocking structures 134. This side of mounting structure lies against the exterior of lower hull section 16 when mounting structure is attached thereto. As described above, interlocking structures (or hooks) 104, 106, 108 on fin 100 engage interlocking structures 134 (also referred to ledges 105, 107, and 109) on mounting structure 130 to releasably secure fin 100 to mounting structure 130.

Figure 11:
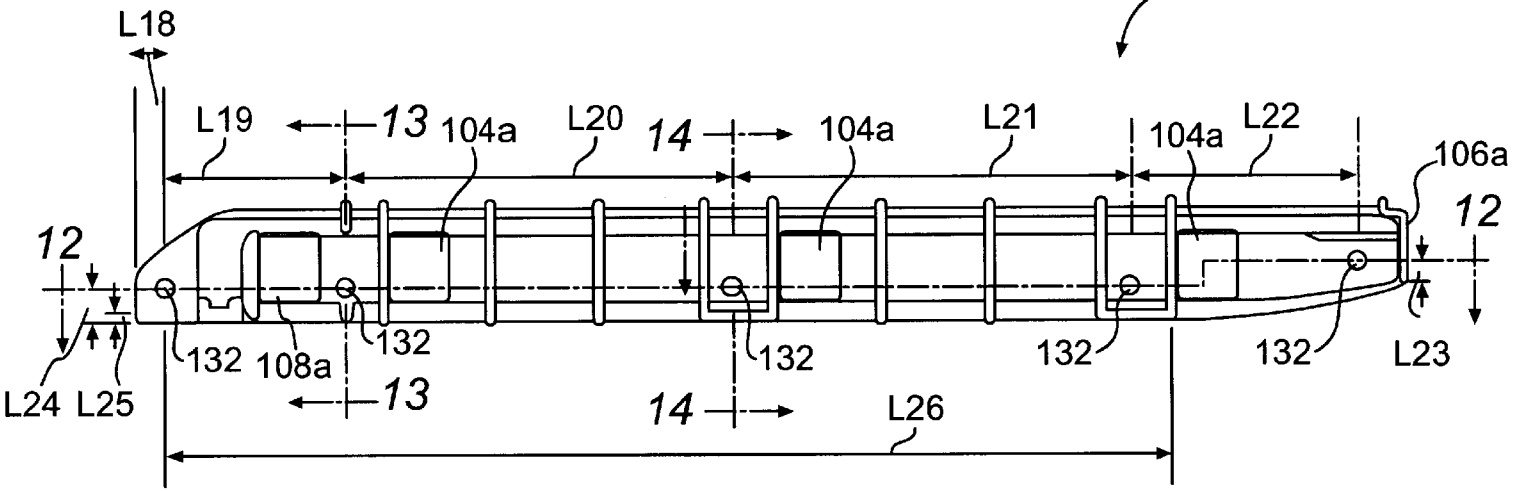
FIG. 11 is a side view of the mounting structure of FIG. 9, opposite to the side view illustrated in FIG. 10.

FIG. 11 illustrates another side of mounting structure 130. This side of mounting structure 130 faces outwardly from lower hull section 16 when mounting structure 130 is attached thereto.

Figure 12:
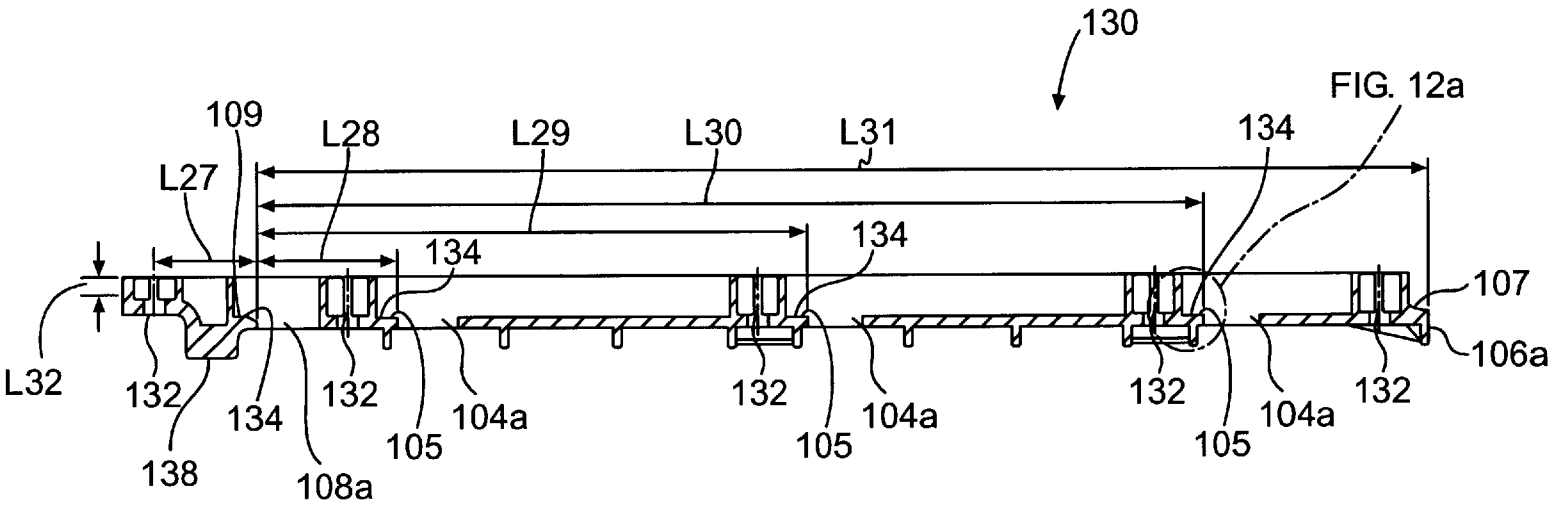
FIG. 12 is a cross-sectional view of the mounting structure taken along line 12—12 of FIG. 11.
Figure 12A:
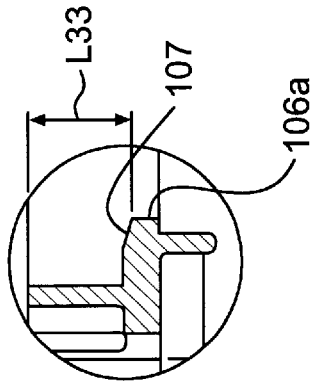
FIG. 12*a* is an enlarged detail of a portion of the mounting structure illustrated in FIG. 12.
Figure 13:
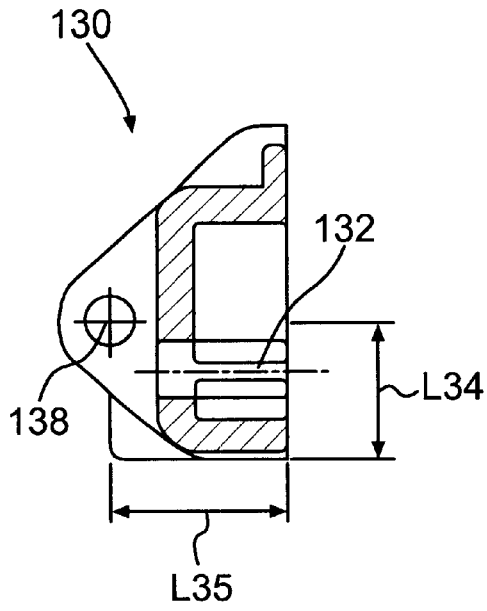
FIG. 13 is a cross-sectional view of the mounting structure taken along line 13—13 of FIG. 11.
Figure 14:
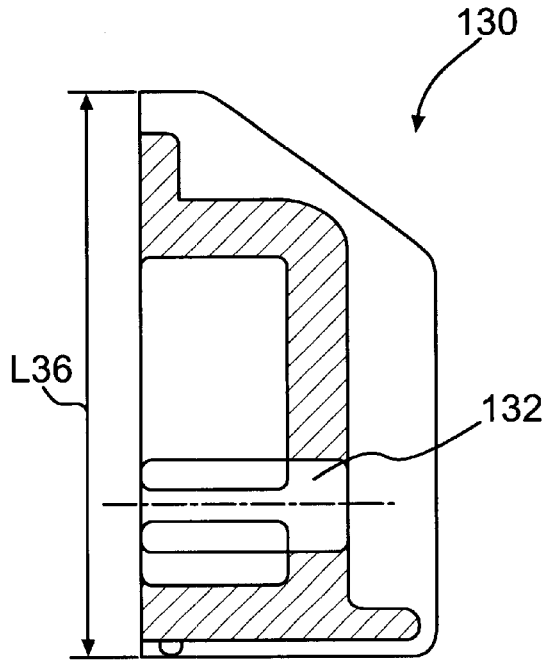
FIG. 14 is a cross-sectional view of the mounting structure taken along line 14—14 of FIG. 11.

FIG. 12 illustrates a cross-sectional view of mounting structure 130 taken along line 12—12 of FIG. 11. FIG. 13 illustrates a cross-sectional view of mounting structure 130 taken along line 13—13 of FIG. 11. FIG. 14 illustrates a cross-sectional view of mounting structure 130 taken along line 14—14 of FIG. 11. Table 2, which references FIGS. 10–14, provides dimensional details of one embodiment of mounting structure 130.

TABLE 2

| FIG. 10 | | FIG. 11 | | FIG. 12 | | FIG. 13 | | FIG. 14 | |
|---|---|---|---|---|---|---|---|---|---|
| LABEL | LENGTH | LABEL | LENGTH | LABEL | LENGTH | LABEL | LENGTH | LABEL | LENGTH |
| L17 | 483 mm | L18 | 11.6 mm | L27 | 35.9 mm | L34 | 18.35 mm | L36 | 44 mm |
| | | L19 | 68 mm | L28 | 50 mm | L35 | 22.5 mm | | |
| | | L20 | 150 mm | L29 | 200 mm | | | | |
| | | L21 | 150 mm | L30 | 350 mm | | | | |
| | | L22 | 85 mm | L31 | 435 mm | | | | |
| | | L23 | 8 mm | L32 | 5 mm | | | | |
| | | L24 | 12 mm | L33 | 12.53 mm | | | | |
| | | L26 | 382.5 mm | | | | | | |

It should be noted that while the illustrated mounting structure 130 is a generally longitudinally-elongated member, mounting structure 130 could have any other suitable shape that would be known to one skilled in the art. For example, mounting structure 130 could be "T" shaped in cross-section. Regardless of the shape of mounting structure 130, it is preferred that fin assembly 200 be removable via longitudinal movement relative to mounting structure 130.

Figure 15:
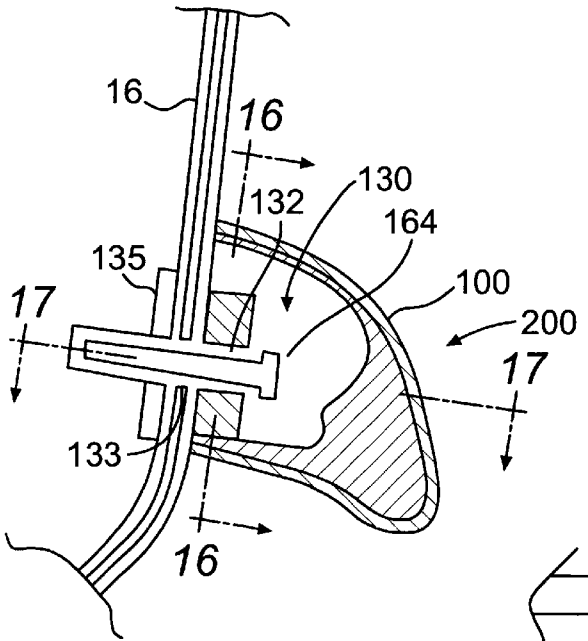
FIG. 15 is a cross-sectional view of the embodiment of the stabilizing fin assembly taken along line 15—15 of FIG. 2.

FIG. 15 illustrates a cross-sectional view of the preferred embodiment of stabilizing fin assembly 200 taken along line 15—15 of FIG. 2. In this embodiment, mounting structure 130 is mounted externally of hull 14 adjacent a lower hull section 16. A portion of hull 14 has a plurality of fastener receiving openings 133 formed therethrough. Similarly, mounting structure 130 has a corresponding plurality of fastener receiving openings 132 formed therethrough. To mount mounting structure 130 to hull 14, mounting structure 130 is placed against the surface of hull 14 with the sets of fastener receiving openings 132 in alignment with holes 133 in hull 14, and a set of fasteners (i.e., threaded bolts) 164 are inserted through the openings 132, 133.

In one contemplated embodiment, a set of complimentary threaded structures (i.e., threaded nuts) (not shown) may be threaded onto the ends of fasteners 164 inside hull 14 to secure mounting structure 130 against the exterior of hull 14. In another contemplated embodiment as shown in FIG. 15, a hull insert 135 may be affixed to the interior of hull 14 to provide additional structural support for the attachment of mounting structure 130 thereto. Alternatively, mounting structure 130 may be externally molded or welded integrally with hull 14.

Figure 21:
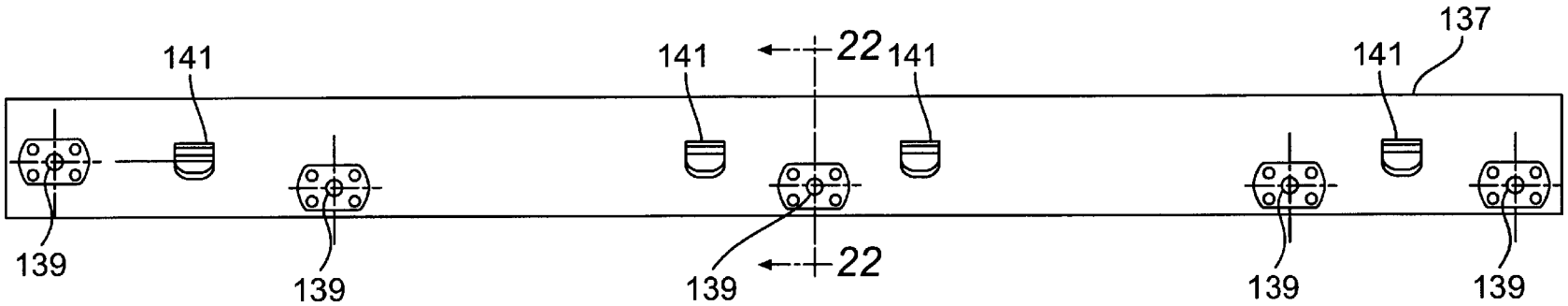
FIG. 21 is a side view of an embodiment of a hull insert according to the present invention.
Figure 22:
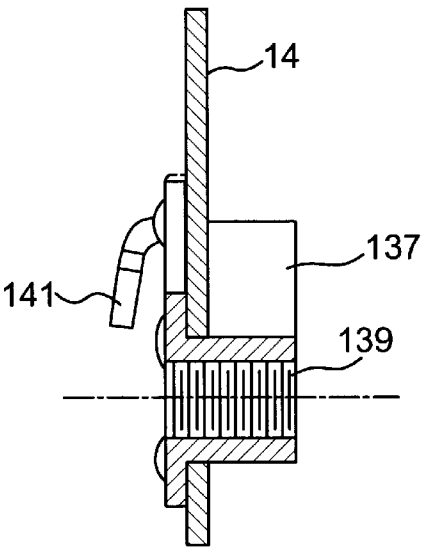
FIG. 22 is a cross-sectional view of the hull insert illustrated in FIG. 21, the view being taken along line 22—22.

FIGS. 21 and 22 illustrate an alternate embodiment of a hull insert 137. In this embodiment, hull insert 137 is affixed to the exterior of hull 14 and includes threaded passages 139 that extend into the interior of hull 14. Hull insert 137 also includes protrusions 141 that extend outwardly from the exterior surface of hull insert 137.

Mounting structure 130 is positioned adjacent to hull insert 137 when mounting structure 130 is affixed to hull 14. In the preferred embodiment, hull insert 137 is affixed to hull 14 by a suitable adhesive. However, as would be appreciated by those skilled in the art, any alternative fastening means could be substituted therefor without deviating from the scope and spirit of the present invention. Threaded fasteners 164 pass through mounting structure 130 and threadedly engage threaded passages 139 in hull insert 137 to secure mounting structure 130 to hull 14.

Alternatively, hull insert 137 may be mounted to the interior of hull 14 so that threaded passages 139 extend exteriorly of hull 14. As before, hull insert 137 is preferably affixed to hull 14 with a suitable adhesive. However, as would be recognized by those skilled in the art, any alternative fastening means could be substituted therefor without deviating from the scope and spirit of the present invention. In this arrangement, threaded fasteners (such as bolts 164) preferably engage threaded passages 139 to secure mounting structure 130 to hull 14. When hull insert 137 is positioned on the interior of hull 14, protrusions 141 may be used as hooks to secure cables, wires, or other similar components to the interior of hull 14.

Figure 16:
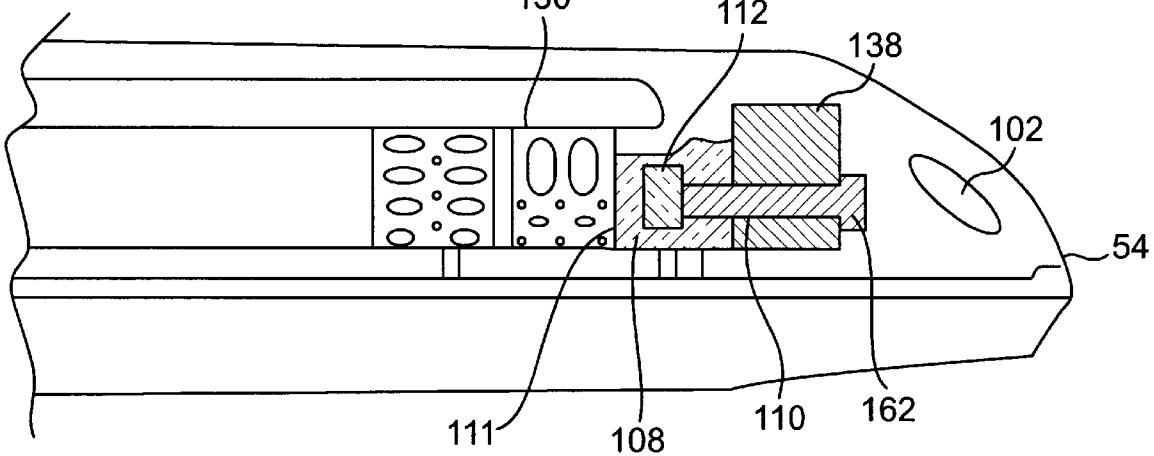
FIG. 16 is a partial cross-sectional view of the stabilizing fin assembly taken along line 16—16 of FIG. 15.

FIG. 16 illustrates a partial cross-sectional view of stabilizing fin assembly 200 taken along line 16—16 of FIG. 15. Interlocking structures (i.e., tabs or hooks) 104, 106, 108 of stabilizing fin structure 100 engage with interlocking structures (i.e., tab receiving openings) 134 of mounting structure 130 in an interlocking relationship to removably support stabilizing fin structure 100 in the operative position thereof. Releasable securement structure 162, which is separable from stabilizing fin structure 100 and mounting structure 130, comprises a threaded fastener (i.e., threaded bolt). In the preferred embodiment, releasable securement structure 162 is inserted through fastener receiving passage 110, and fastener receiving opening 102 of stabilizing fin structure 100 and fastener receiving opening 138 of mounting structure 130 in the operative position thereof and threaded onto threaded structure (i.e., threaded nut) 112 to provide the releasably secured position of releasable securement structure 162. Releasable securement structure 162 is easily accessible from rearward portion of stabilizing fin structure 100, and in the releasably secured position thereof releasably secures stabilizing fin structure 100 to mounting structure 130 by maintaining interlocking structures 104, 106, 108, 134 removably engaged in the interlocking relationship.

Figure 1:
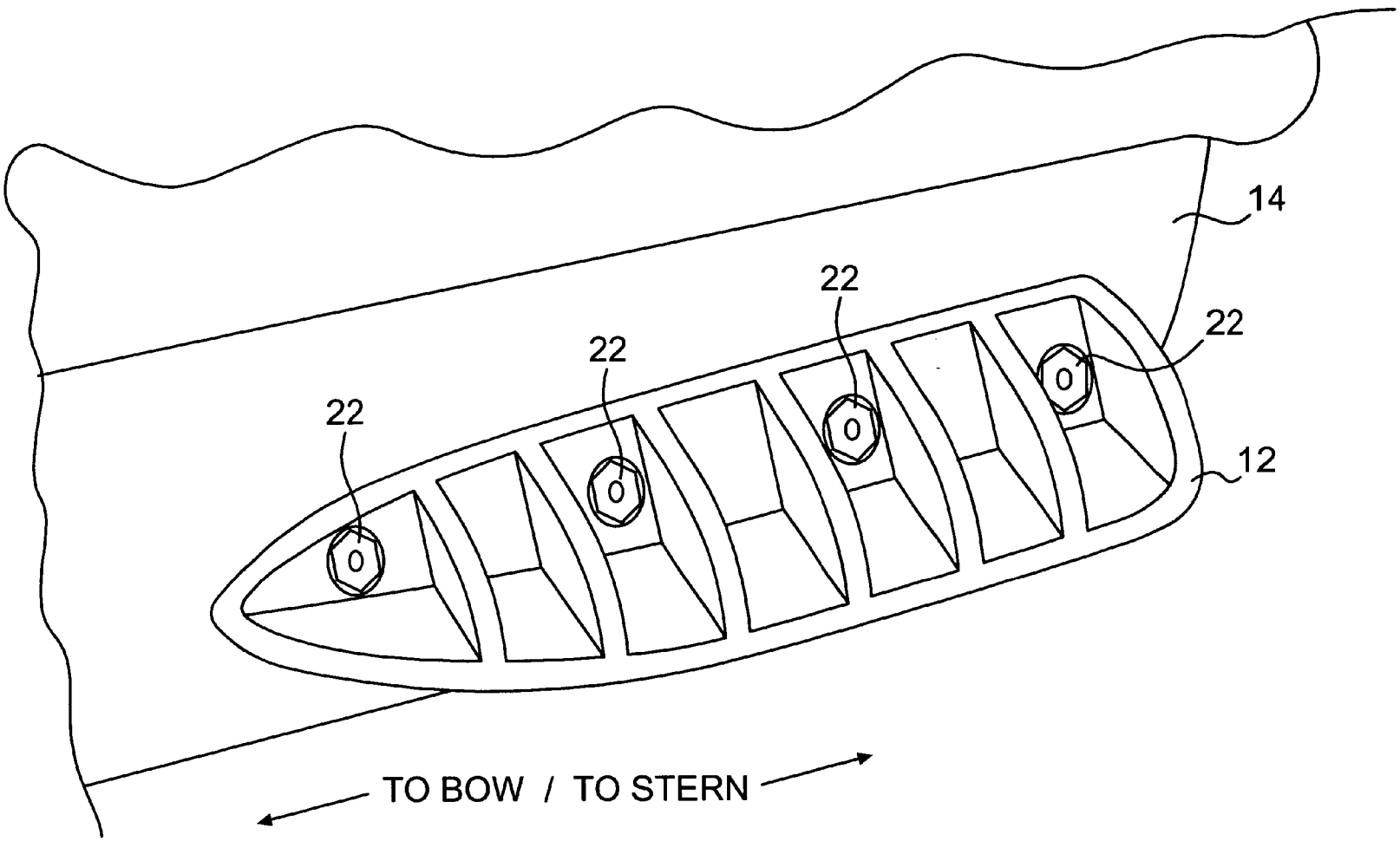
FIG. 1 PRIOR ART
FIG. 1 is a side view of a prior art arrangement of a stabilizing fin.

In the releasably secured position, releasable securement structure 162 may be positioned in any angle relative to the surface of the body of water, as long as it releasably secures stabilizing fin structure 100 to mounting structure 130 by maintaining interlocking structures 104, 106, 108, 134 removably engaged in the interlocking relationship. FIG. 16 illustrates releasable securement structure 162 oriented close to parallel to the surface of the body of water in the releasably secured position. In this releasably secured position, threaded fastener 162 is hidden within stabilizing fin structure 100. Alternatively, releasable securement structure 162 may be easily accessible from forward portion of stabilizing fin structure 100. Such configurations are unlike the plurality of fasteners 22 (FIG. 1), which require that stabilizing fin 12 be covered with a stabilizing fin cover. As such, stabilizing fin structure 100 is more aesthetically pleasing than stabilizing fin 12 of the prior art.

To move releasable securement structure 162 to the released position thereof, the operator simply loosens and removes threaded fastener 162 from the rear (or front) of stabilizing fin assembly 200. When threaded fastener 162 is removed, stabilizing fin structure 100 can be moved relative to mounting structure 130 so as to disengage interlocking structures 104, 106, 108, 134 from one another to separate stabilizing fin structure 100 from mounting structure 130. Interlocking structures (i.e., tabs) 104, 106, 108 of stabilizing fin structure 100 and interlocking structures (i.e., tab receiving openings) 134 (specifically, ledges 105, 107, 109) of mounting structure 130 are oriented such that when releasable securement structure 162 is in the released position thereof, stabilizing fin structure 100 is movable generally parallel to mounting structure 130. Fastener receiving opening 102 allows for releasable securement structure 162 to be easily secured or loosened from the rear (or front) of stabilizing fin assembly 200.

Alternatively, releasable securement structure 162 may comprise a screw, for example, with Loctite® 271 (a non-permanent adhesive), that locks onto structure 112 to provide the releasably secured position of releasable securement structure 162.

Also, it should be noted that structure 162, while preferably a threaded fastener, could take any suitable shape so long as structure 162 rigidly and securely fastens fin structure 100 to watercraft 10. For example, structure 162 might be a key-like element with a locking protrusion at its end. So constructed, the key would be inserted into passage 110 and then turned to lock fin 100 in place. If structure 162 has such a construction, passage 110 would be similarly fashioned to accommodate the locking mechanism. Other suitable locking structures are known to those skilled in the art.

After structure 162 is inserted into passage 110, opening 102 may be capped by a suitable plug to conceal opening 102 and improve the appearance of watercraft 10.

Figure 18:
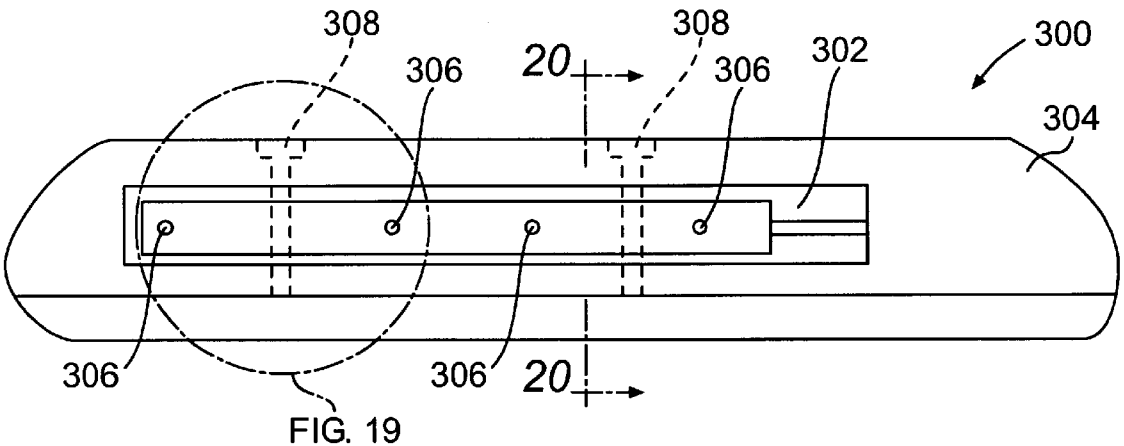
FIG. 18 is a side view of another embodiment of the stabilizing fin of the present invention.
Figure 19:
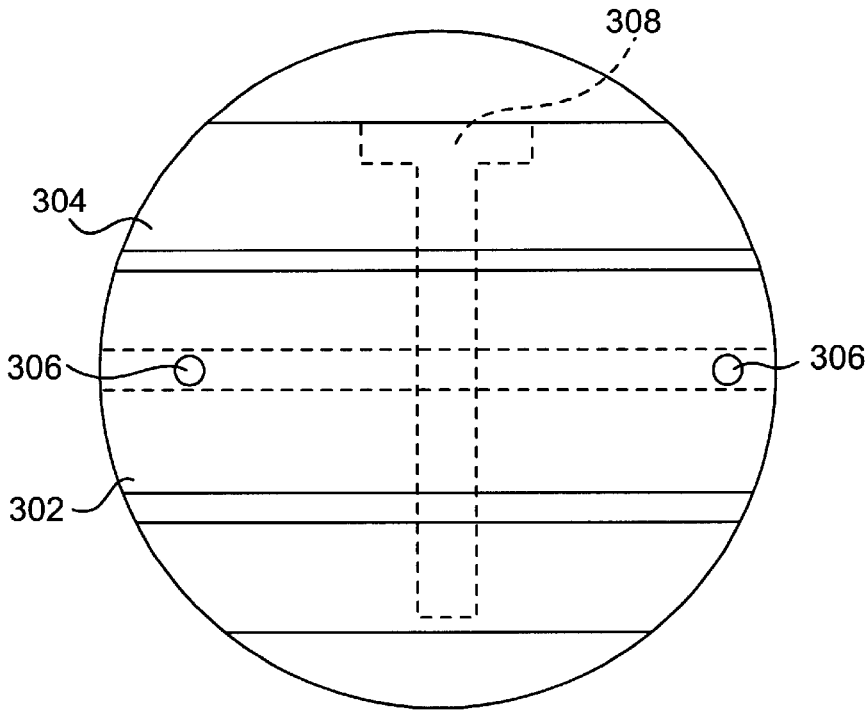
FIG. 19 is an enlarged side view of the portion of the stabilizing fin within the circle in FIG. 18 designated as 19—19.
Figure 20:
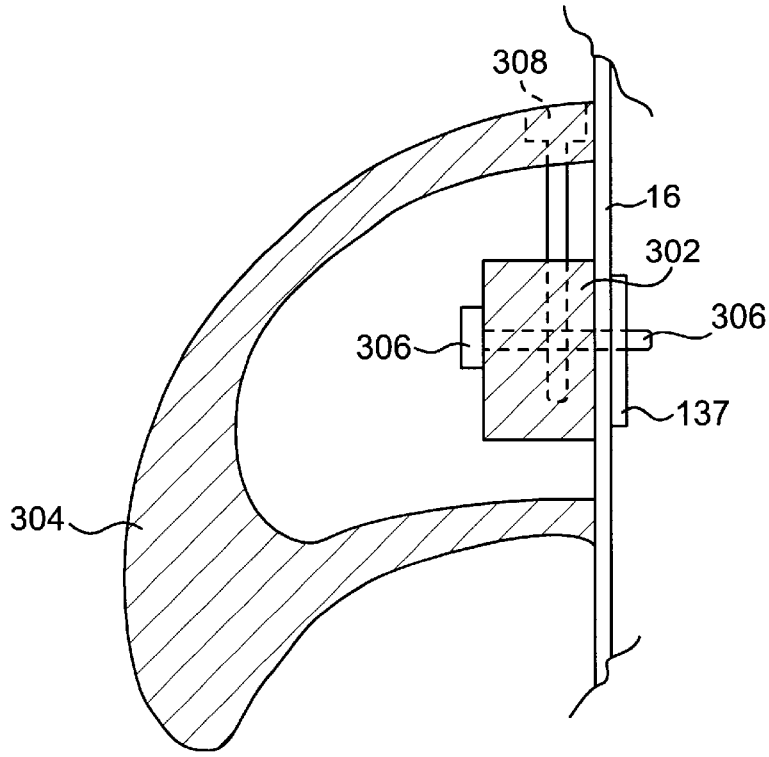
FIG. 20 is a cross-sectional view of the stabilizing fin illustrated in FIG. 18, taken along line 20—20.

Another embodiment of the stabilizing fin structure 300 is illustrated in FIGS. 18–20. Stabilizing fin structure 300 is mounted to hull 14 (specifically, lower hull section 16) in the same manner as other embodiments described above. Specifically, mounting structure 302 is attached to the exterior of lower hull section 16 preferably with threaded fasteners 306 disposed through lower hull section 16. A hull insert (either 132 or 137) may be used to facilitate attachment of mounting structure 302 to lower hull section 16.

In this particular embodiment, mounting structure 302 engages fin structure 304 in the same manner as fin structure 100 engages mounting structure 130 in previous embodiments. Specifically, fin structure 304 includes interlocking members or hooks disposed on its inner surface. The hooks engage ledges on mounting structure 302, just as hooks 104, 106, 108 on fin 100 engage ledges 105, 107, 109 on mounting structure 130.

Stabilizing fin structure 300 differs from previous embodiments in that fin structure 304 releasably connects to mounting structure 302 via fasteners 308. In the preferred embodiment, fasteners 308 are threaded members such as bolts that are inserted through an upper surface of fin structure 304 and extend downwardly into mounting structure 302. Alternatively, fasteners could extend upwardly to mounting structure 302 from the bottom surface of fin structure 304. While threaded fasteners 308 are preferred in this embodiment, those skilled in the art would readily recognize that other types of fasteners could be used. For example, fasteners 308 could be of a key-type that interlock with mounting structure 302 without threadedly engaging mounting structure 302.

If fasteners 308 are used to connect fin structure 304 with mounting structure 302, preferably, a cap will be inserted into fin structure 304 above each fastener 308 so that the operator does not see fasteners 308. This improves the overall appearance of fin structure 304 when it is attached to watercraft 10 and assures that fin 300 presents a smooth surface to the water in which it operates.

In order to be robust (i.e., impact resistant), stabilizing fin structure 100 and mounting structure 130 may be manufactured, for example, from one of an ABS (Acetyl Butyl Styrene) nylon, such as Triax™, material with fibers (e.g., reinforced resin), an ABS polyamide, and of a high density polyethylene, such as fiberglass reinforced resin. In one embodiment, stabilizing fin structure 100 is 30% (i.e., BKV 30) charged with fiberglass. In other embodiments, stabilizing fin structure 100 may be 50% (i.e., BKV 50) or 15% (i.e., BKV 15) charged with fiberglass. Stabilizing fin structure 100 and mounting structure 136 is formed by injection molding.

Although this invention has been shown in relation to particular embodiments, it should not be considered so limited. Rather, the present invention is limited only by the scope of the appended claims and their equivalents.

What is claimed is:

1. A watercraft comprising:

a hull for buoyantly supporting said watercraft on a surface of a body of water;

a power-operated propulsion system constructed and arranged to move said watercraft along the surface of the body of water;

a steering control system including a steering input device, said steering control system being constructed and arranged to steer said watercraft based on movement of said steering input device by an operator riding said watercraft; and at least one stabilizing fin assembly comprising a mounting structure fixedly attached to an associated one of a port and starboard side portions of said hull;

a stabilizing fin structure disposed externally of said hull and adjacent the associated one of said port and starboard side portions of said hull in an operative position wherein at least a portion of said stabilizing fin structure extends into the body of water while said watercraft is in a normal upright position; and a releasable securement structure disposed in a releasably secured position wherein said releasable securement structure releasably secures said stabilizing fin structure to said mounting structure with said releasable securement structure and said mounting structure cooperating to releasably retain said stabilizing fin structure in said operative position thereof, said releasable securement structure being constructed and arranged to be moved from said releasably secured position to a released position wherein said releasable securement structure releases said stabilizing fin structure from said mounting structure so as to permit said stabilizing fin structure to be removed from said operative position thereof, and being accessible entirely externally of said hull without the need for accessing an interior of said hull for movement between said releasably secured and released positions thereof, wherein said mounting structure has a threaded bore, said stabilizing fin structure has a fastener receiving opening, and said releasable securement structure comprises a threaded fastener, said threaded fastener being inserted through the fastener receiving opening of said stabilizing fin structure in said operative position thereof and threaded onto the threaded bore of said mounting structure to provide the releasably secured position of said releasable securement structure.

2. A watercraft according to claim 1, wherein said releasable securement structure comprises is a unitary structure.

3. A watercraft according to claim 1, wherein said mounting structure is mounted externally of said hull adjacent an associated one of said starboard and port side portions.

4. A watercraft according to claim 1, wherein said stabilizing fin structure provides lift for and improves turning grip of said watercraft on the surface of the body of water.

5. A watercraft according to claim 1, wherein said mounting structure includes only one interlocking structure and said stabilizing fin structure includes only one interlocking structure, said interlocking structures of said stabilizing fin structure and mounting structure being engaged with one another in an interlocking relationship to removably support said stabilizing fin structure in said operative positions thereof, said releasable securement structure in said releasably secured position thereof releasably securing said stabilizing fin structure to said mounting structure by maintaining said interlocking structures removably engaged in said interlocking relationship, said releasable securement structure in said released position thereof permitting said stabilizing fin structure to be moved relative to said mounting structure so as to disengage said interlocking structures from one another and then to be separated from said stabilizing fin structure.

6. A watercraft according to claim 1, wherein said mounting structure includes a plurality of interlocking structures and said stabilizing fin structure includes a plurality of interlocking structures, said interlocking structures of said stabilizing fin structure and mounting structure being engaged with one another in an interlocking relationship to removably support said stabilizing fin structure in said operative positions thereof, said releasable securement structure in said releasably secured position thereof releasably securing said stabilizing fin structure to said mounting structure by maintaining said interlocking structures removably engaged in said interlocking relationship, said releasable securement structure in said released position thereof permitting said stabilizing fin structure to be moved relative to said mounting structure so as to disengage said interlocking structures from one another and then to be separated from said stabilizing fin structure.

7. A watercraft according to claim 6, wherein said interlocking structures on said stabilizing fin are tabs that extend toward said mounting structure and said interlocking structures on said mounting structure are ledges that cooperate with said tabs.

8. A watercraft according to claim 7, wherein said tabs face a rear of said hull.

9. A watercraft according to claim 6, wherein said interlocking structures of said stabilizing fin structure are provided by a plurality of tabs and wherein the interlocking structures of said mounting structure are provided by a plurality of tab receiving openings configured to receive said tabs, said tabs being received within said tab receiving openings to provide the aforesaid interlocking relationship.

10. A watercraft according to claim 9, wherein said tabs and said tab receiving openings are oriented such that when said releasable securement structure is in said released position thereof permitting said stabilizing fin structure to be moved generally parallel to said mounting structure.

11. A watercraft according to claim 10, wherein said tabs face a rear of said hull.

12. A watercraft according to claim 1, wherein said threaded fastener is accessible from at least one of a rearward end portion and a forward end portion of said stabilizing fin assembly.

13. A watercraft according to claim 1, wherein said threaded fastener comprises a plurality of threaded fasteners and said fastener receiving opening comprises a plurality of fastener receiving openings, and wherein said fasteners extend into said stabilizing fin structure in a direction substantially perpendicularly to a longitudinal direction of said stabilizing fin structure.

14. A watercraft according to claim 13, wherein said fasteners are accessible through a top surface of said stabilizing fin structure.

15. A watercraft according to claim 13, wherein said fasteners are accessible through a bottom surface of said stabilizing fin structure.

16. A watercraft according to claim 1, wherein said releasable securement structure is separable from said mounting structure and said stabilizing fin structure.

17. A watercraft according to claim 1, wherein said mounting structure and said stabilizing fin structure are formed by injection molding.

18. A watercraft according to claim 1, wherein at least part of said mounting structure and said stabilizing fin structure are composed of at least one of an ABS nylon with fibers and of a high density polyethylene.

19. A stabilizing fin assembly for use with a watercraft, said fin assembly comprising:

a mounting structure constructed and arranged to be fixedly attached to a side portion of a hull of said watercraft;

a stabilizing fin structure constructed and arranged to be removably mounted to said mounting structure such that when said mounting structure is fixedly attached to said hull said stabilizing fin structure being disposed externally of said hull and adjacent said side portion of said hull in an operative position wherein at least a portion of said stabilizing fin structure extends into a body of water while said watercraft is in a normal upright position; and a releasable securement structure constructed and arranged to be disposed in a releasably secured position wherein said releasable securement structure releasably secures said stabilizing fin structure to said mounting structure with said releasable securement structure and said mounting structure cooperating to releasably retain said stabilizing fin structure in said operative position thereof, said releasable securement structure constructed and arranged to be moved from said releasably secured position to a released position wherein said releasable securement structure releases said stabilizing fin structure from said mounting structure so as to permit said stabilizing fin structure to be removed from said operative position thereof, and being accessible entirely externally of said hull without the need for accessing an interior of said hull for movement between said releasably secured and released positions thereof, wherein said mounting structure has a threaded bore, said stabilizing fin structure has a fastener receiving opening, and said releasable securement structure comprises a threaded fastener, said threaded fastener being inserted through the fastener receiving opening of said stabilizing fin structure in said operative position thereof and threaded onto the threaded bore of said mounting structure to provide the releasably secured position of said releasable securement structure.

20. A stabilizing fin assembly according to claim 19, wherein said releasable securement structure comprises is a unitary structure.

21. A stabilizing fin assembly according to claim 19, wherein said mounting structure is constructed and arranged to be mounted externally of said hull adjacent to said side portion of said hull.

22. A stabilizing fin assembly according to claim 19, wherein at least part of said mounting structure and said stabilizing fin structure are composed of at least one of an ABS nylon with fibers and of a high density polyethylene.

23. A stabilizing fin assembly according to claim 19, wherein said stabilizing fin structure provides lift for and improves turning grip of said watercraft on the body of water.

24. A stabilizing fin assembly according to claim 19, wherein said mounting structure includes only one interlocking structure and said stabilizing fin structure includes only one interlocking structure, said interlocking structures of said stabilizing fin structure and mounting structure being engaged with one another in an interlocking relationship to removably support said stabilizing fin structure in said operative positions thereof, said releasable securement structure in said releasably secured position thereof releasably securing said stabilizing fin structure to said mounting structure by maintaining said interlocking structures removably engaged in said interlocking relationship, said releasable securement structure in said released position thereof permitting said stabilizing fin structure to be moved relative to said mounting structure so as to disengage said interlocking structures from one another and then to be separated from said stabilizing fin structure.

25. A stabilizing fin assembly according to claim 19, wherein said mounting structure includes a plurality of interlocking structures and said stabilizing fin structure includes a plurality of interlocking structures, said interlocking structures of said stabilizing fin structure and mounting structure being engaged with one another in an interlocking relationship to removably support said stabilizing fin structure in said operative position thereof, said releasable securement structure in said releasably secured position thereof releasably securing said stabilizing fin structure to said mounting structure by maintaining said interlocking structures removably engaged in said interlocking relationship, said releasable securement structure in said released position thereof permitting said stabilizing fin structure to be moved relative to said mounting structure so as to disengage said interlocking structures from one another and then to be separated from said stabilizing fin structure.

26. The stabilizing fin assembly according to claim 25, wherein said interlocking structures on said stabilizing fin are tabs that extend toward said mounting structure and said interlocking structures on said mounting structure are ledges that cooperate with said tabs.

27. The stabilizing fin assembly according to claim 26, wherein said tabs face a rear of said hull.

28. A stabilizing fin assembly according to claim 25, wherein said interlocking structures of said stabilizing fin structure are provided by a plurality of tabs and wherein the interlocking structures of said mounting structure are provided by a plurality of tab receiving openings configured to receive said tabs, said tabs being received within said tab receiving openings to provide the aforesaid interlocking relationship.

29. A stabilizing fin assembly according to claim 28, wherein said tabs face a rear of said hull.

30. A stabilizing fin assembly according to claim 28, wherein said tabs and said tab receiving openings are oriented such that when said releasable securement structure is in said released position thereof permitting said stabilizing fin structure to be moved generally parallel to said mounting structure.

31. A stabilizing fin assembly according to claim 19, wherein said threaded fastener is accessible from at least one of rearward end portions and of forward end portions of said stabilizing fin structure.

32. A stabilizing fin assembly according to claim 31, wherein said threaded fastener comprises a plurality of threaded fasteners and said fastener receiving opening comprises a plurality of fastener receiving openings, and wherein said fasteners extend into said stabilizing fin structure in a direction substantially perpendicularly to a longitudinal direction of said stabilizing fin structure.

33. A stabilizing fin assembly according to claim 32, wherein said fasteners are accessible through a top surface of said stabilizing fin structure.

34. A stabilizing fin assembly according to claim 32, wherein said fasteners are accessible through a bottom surface of said stabilizing fin structure.

35. A stabilizing fin assembly according to claim 19, wherein said releasable securement structure is separable from said mounting structure and said stabilizing fin structure.

36. A stabilizing fin assembly according to claim 19, wherein said mounting structure and said stabilizing fin structure are formed by injection molding.

37. A stabilizing fin assembly for use with a watercraft, said fin assembly comprising:

a mounting structure constructed and arranged to be fixedly attached to a side portion of a hull of a watercraft;

a stabilizing fin structure constructed and arranged to be removably mounted to said mounting structure, said stabilizing fin structure being disposed externally of said hull and adjacent said side portion of said hull; and a releasable securement structure constructed and arranged to cooperate with said mounting structure to releasably secure said stabilizing fin structure to said mounting structure, said releasable securement structure being accessible entirely externally of said hull, wherein said mounting structure has a threaded bore, said stabilizing fin structure has a fastener receiving opening, and said releasable securement structure comprises a threaded fastener, said threaded fastener being inserted through the fastener receiving opening of said stabilizing fin structure and threaded onto the threaded bore of said mounting structure to releasably secure said stabilizing fin structure to said mounting structure.

38. A stabilizing fin assembly according to claim 37, wherein said releasable securement structure comprises is a unitary structure.

39. A stabilizing fin assembly according to claim 37, wherein said mounting structure is constructed and arranged to be mounted externally of said hull adjacent to said side portion of said hull.

40. A stabilizing fin assembly according to claim 37, wherein said mounting structure and said stabilizing fin structure are formed by injection molding.

41. A stabilizing fin assembly according to claim 37, wherein at least part of said mounting structure and said stabilizing fin structure are composed of at least one of an ABS nylon with fibers and of a high density polyethylene.

42. A stabilizing fin assembly according to claim 37, wherein said stabilizing fin structure provides lift for and improves turning grip of said watercraft on a surface of a body of water.

43. A stabilizing fin assembly according to claim 37, wherein each of said mounting structure and said stabilizing fin structure includes only one interlocking structure to engage said stabilizing fin structure to said mounting structure.

44. A stabilizing fin assembly according to claim 37, wherein each of said mounting structure and said stabilizing fin structure includes a plurality of interlocking structures to engage said stabilizing fin structure to said mounting structure.

45. A stabilizing fin assembly according to claim 44, wherein said interlocking structures of said stabilizing fin structure are provided by a plurality of tabs and wherein the interlocking structures of said mounting structure are provided by a plurality of tab receiving openings configured to receive said tabs, said tabs being received within said tab receiving openings to engage said stabilizing fin structure to said mounting structure.

46. A stabilizing fin assembly according to claim 44, wherein said interlocking structures on said stabilizing fin are tabs that extend toward said mounting structure and said interlocking structures on said mounting structure are ledges that cooperate with said tabs.

47. A stabilizing fin assembly according to claim 46, wherein said tabs face a rear of said hull.

48. A stabilizing fin assembly according to claim 45, wherein said tabs and said tab receiving openings are oriented such that when said releasable securement structure is in said released position thereof permitting said stabilizing fin structure to be moved generally parallel to said mounting structure.

49. A stabilizing fin assembly according to claim 37, wherein said threaded fastener is accessible from at least one of a rear end and a front end of said stabilizing fin structure.

50. A stabilizing fin assembly according to claim 37, wherein said threaded fastener comprises a plurality of threaded fasteners and said fastener receiving opening comprises a plurality of fastener receiving openings, and wherein said fasteners extend into said stabilizing fin structure in a direction substantially perpendicularly to a longitudinal direction of said stabilizing fin structure.

51. A stabilizing fin assembly according to claim 50, wherein said fasteners are accessible through a top surface of said stabilizing fin structure.

52. A stabilizing fin assembly according to claim 50, wherein said fasteners are accessible through a bottom surface of said stabilizing fin structure.

53. A stabilizing fin assembly according to claim 37, wherein said releasable securement structure is separable from said mounting structure and said stabilizing fin structure.

54. A stabilizing fin adapted to be affixed to a watercraft via a mounting structure, comprising:

a shell defining an elongated body of the fin having an interior surface defining an interior chamber, such that the elongated body is hollow;

said interior surface including at least one interlocking member within the interior chamber; and said shell defining an opening through the body, permitting access to said interior chamber.

55. A stabilizing fin according to claim 54, wherein said at least one interlocking member comprises a plurality of interlocking members.

56. A stabilizing fin according to claim 54, wherein said at least one interlocking member comprises only one interlocking member.

57. A stabilizing fin according to claim 54, wherein each of said at least one interlocking members is a tab extending into said interior from said interior surface.

58. A stabilizing fin according to claim 54, wherein said opening is located at one of a fore or aft end of said shell.

59. A stabilizing fin according to claim 54, wherein said opening comprises a plurality of openings disposed along one of a top or bottom of said shell.

* * * * *